United States Patent [19]

Thompson

[11] 4,195,332

[45] Mar. 25, 1980

[54] LUMINAIRE HOIST SAFETY DEVICE WITH AUTOMATIC BRAKE MEANS ADJACENT TOP CABLE GUIDE

[75] Inventor: Richard L. Thompson, Hendersonville, N.C.

[73] Assignee: General Electric Company, Schenectady, N.Y.

[21] Appl. No.: 908,187

[22] Filed: May 22, 1978

[51] Int. Cl.[2] ..... F21V 21/36

[52] U.S. Cl. ..... 362/391; 362/403; 362/431

[58] Field of Search ..... 362/391, 396, 401–403, 362/431

[56] References Cited

U.S. PATENT DOCUMENTS

| | | | |
|---|---|---|---|
| 256,354 | 4/1882 | Morgan . | |
| 537,783 | 4/1895 | Littleworth . | |
| 661,754 | 11/1900 | Burton . | |
| 2,232,890 | 2/1941 | Stillwagon . | |
| 2,564,267 | 8/1951 | Manke . | |
| 3,840,212 | 10/1974 | Latanision | 362/403 X |
| 3,944,218 | 3/1976 | Cerny . | |
| 3,958,116 | 5/1976 | Jones | 362/401 |
| 4,001,573 | 1/1977 | Derasp | 362/403 |
| 4,092,707 | 5/1978 | Millerbernd | 362/391 |
| 4,115,845 | 9/1978 | Blahut | 362/403 |

*Primary Examiner*—Peter A. Nelson

*Attorney, Agent, or Firm*—Sidney Greenberg; Lawrence R. Kempton

[57] ABSTRACT

Safety device for preventing fall of pole-mounted luminaire support due to breaking of hoisting cable. Device comprises pivoted brake arm which automatically clamps and holds the support cable in the event the hoisting cable breaks during hoisting or lowering operations.

10 Claims, 6 Drawing Figures

LUMINAIRE HOIST SAFETY DEVICE WITH AUTOMATIC BRAKE MEANS ADJACENT TOP CABLE GUIDE

The present invention relates to hoisting apparatus for raising and lowering a luminaire support on a pole, and more particularly concerns a safety device for such hoisting apparatus.

It is an object of the invention to provide a safety device for preventing fall of a load support mounted for hoisting and lowering on a pole.

A particular object of the invention is to provide a safety device for preventing fall of a pole-mounted luminaire support due to breaking of the hoisting cable employed for raising and lowering the luminaire support on the pole.

Another object of the invention is to provide a safety device of the above type which is quick-acting and reliable in operation to automatically prevent the load from falling upon breakage of the hoisting cable.

Other objects and advantages will become apparent from the following description and the appended claims.

With the above objects in view, the present invention in one of its aspects relates to a hoist apparatus and safety device therefor comprising, in combination, a pole, fixed support means secured at the top of the pole, load support means movable between the top and bottom of the pole, hoist means for raising and lowering the load support means on the pole, the hoist means comprising cable winding means at the bottom of the pole, cable guide means mounted on the fixed support means, and hoist cable means passing around the guide means and connected at one end to the load support means and at the other end to the cable winding means, and brake means adjacent to the guide means and in operative engagement with the hoist cable means for automatically clamping and holding the hoist cable means in the event of breakage thereof.

In a preferred embodiment, the brake means comprises a pivotally mounted, spring biased brake arm swingable between an inoperative position out of engagement with the cable means and an operative position in clamping engagement with the cable means, the brake arm being normally held in inoperative position by the cable means under loaded tension and being automatically moved by the spring bias into operative position when breakage of the cable means removes the tension thereon.

The invention will be better understood from the following description taken in conjunction with the accompanying drawings, in which.

Figure 1:
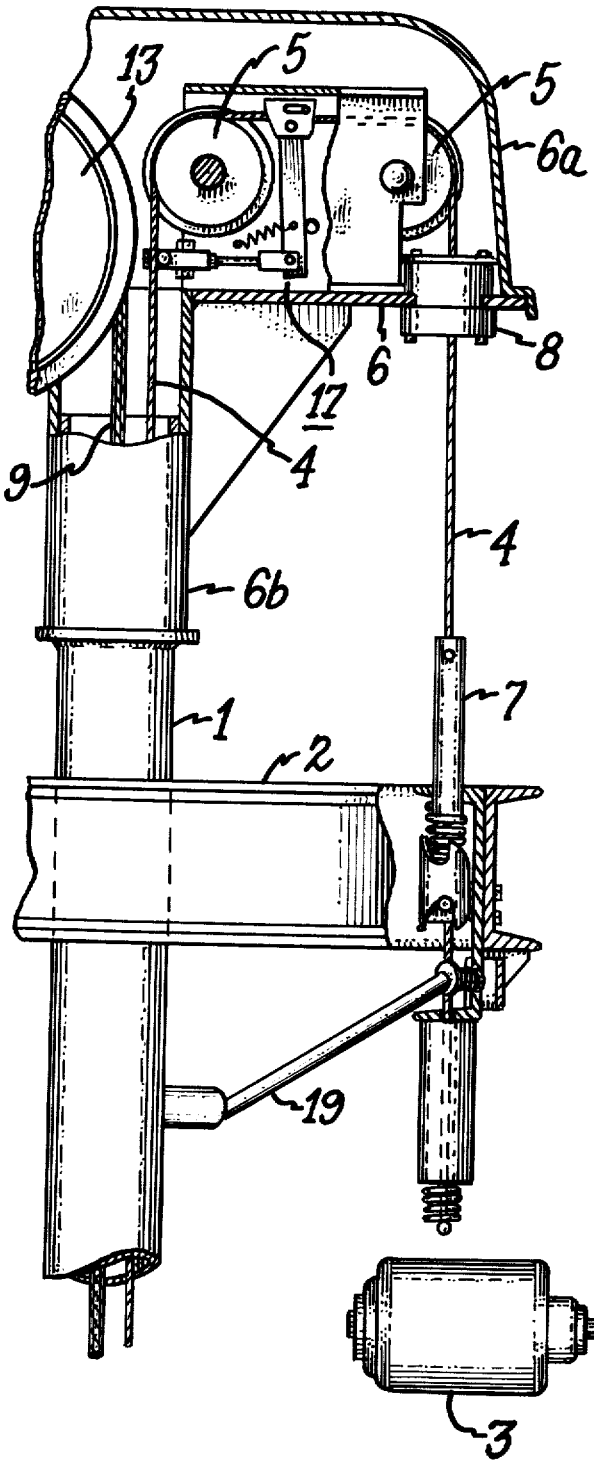
FIG. 1 is a view in elevation of the upper portion of a pole having a luminaire support mounted thereon and hoist means for raising and lowering the luminaire support on the pole, and including a cable brake device in accordance with an embodiment of the invention.
Figure 2:
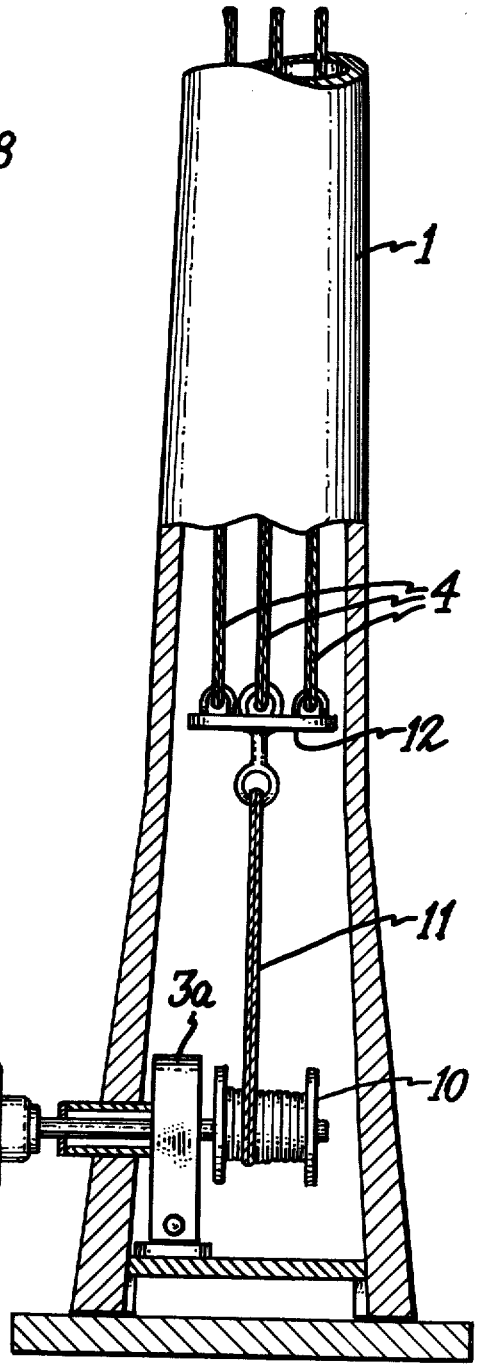
FIG. 2 is a view in elevation of the lower portion of the pole, with parts broken away, showing the hoisting and support cables and winch for moving the cables.

Referring now to the drawings, and particularly to FIGS. 1 and 2, there is shown light pole 1 of high-mast type which is of tubular shape tapering somewhat toward its upper end. Mounted on the top of pole 1 is head plate 6 having a dome-shaped cover 6*a* and sleeve (slip-fitter) 6*b* which fits over the top portion of the pole. Surrounding pole 1 is luminaire support ring 2 having secured thereto a number of luminaires (not shown) uniformly spaced around the support ring. A plurality of hoisting cables 4 (typically three) secured to support ring 2 pass over correspondingly arranged pairs of rotatable guides or sheaves 5 mounted on head plate 6 and extend downwardly through the interior of the pole to winch apparatus 10 at the bottom of the pole driven by motor 3 through gear box 3*a*, the winch being operable for raising and lowering luminaire support ring 2 by winding and unwinding winch cable 11 connected to hoist cables 4 by plate 12. Support ring 2 is held in its uppermost (operative) position by a plurality of latches 7 mounted on ring 2 to which the hoist cables 4 are respectively attached and which engage latch locking devices 8 correspondingly arranged on head plate 6. The latching apparatus and its operation are more fully disclosed in related co-pending Thompson application Ser. No. 826,497 filed Aug. 22, 1977 and assigned to the same assignee as the present invention.

Power cable 9 for transmitting current to the luminaires passes around power cable sheave 13 and downward through pole 1 for connection to a power source (not shown) near the bottom of the pole.

Apparatus comprising spring loaded guide members 19 for maintaining support ring 2 substantially centered relative to pole 1 and for preventing impact shock to the luminaires mounted on ring 2 is shown and described more fully in co-pending Thompson application Ser. No. 818,368, filed July 25, 1977, and assigned to the same assignee as the present invention.

Figure 3:
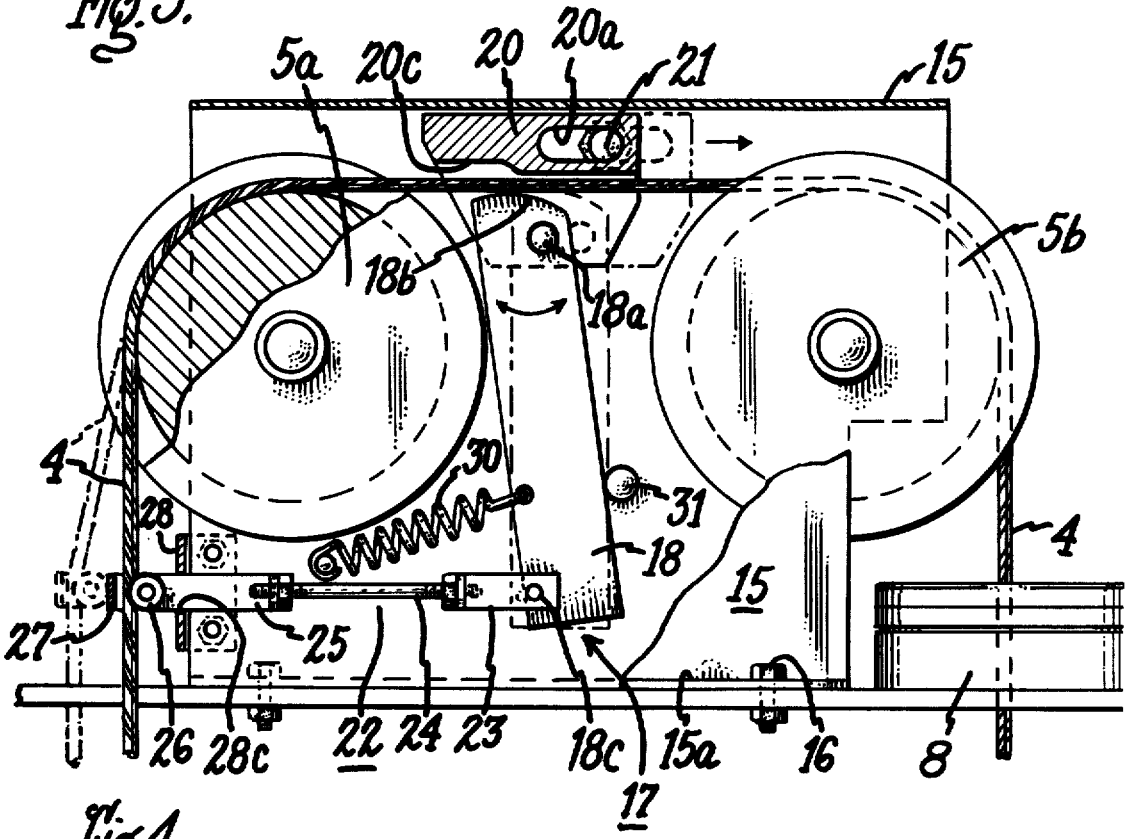
FIG. 3 is an enlarged detail view of the cable brake mechanism shown in FIG. 1.
Figure 4:
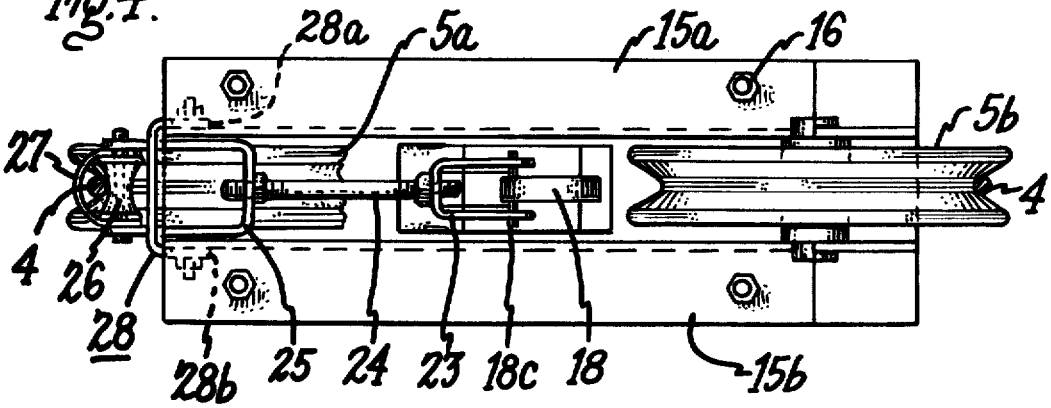
FIG. 4 is a bottom view of the device shown in FIG. 3.
Figure 5:
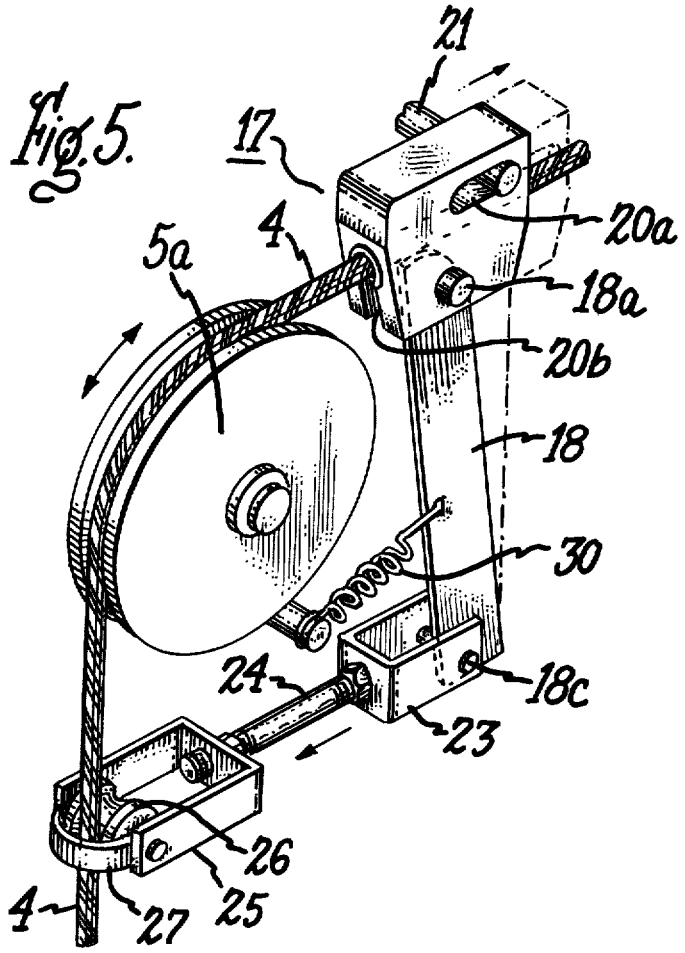
FIG. 5 is a perspective view of the brake mechanism.

In accordance with the present invention, a safety device is incorporated in the luminaire hoisting apparatus to stop the fall of luminaire support ring 2 in the event of breakage of winch cable 11 or hoist cables 4. In the embodiment illustrated in the drawings, each set of sheaves 5*a*, 5*b* is mounted in spaced relation on bracket 15 which is of inverted U-shape in vertical cross-section and has oppositely extending bottom flanges 15*a*, 15*b* (see FIG. 4) resting on head plate 6 and secured thereto by bolts 16 or the like. Braking apparatus 17, shown in perspective in FIG. 5, is installed on bracket 15 adjacent the set of sheaves 5*a*, 5*b* in operative association with cable 4 passing around the sheaves, as seen in FIG. 3. The brake device comprises brake arm 18 pivotably connected by dowel pin 18*a* near its upper end to arm support 20, which in turn is slidably connected by bolt 21 to the upper portion of bracket 15. Bolt 21 passes freely through slot 20*a* in arm support 20, the slot being dimensioned to limit the forward and rearward movement of arm support 20 to the desired extent, as hereinafter explained.

Brake arm 18 projects at its upper end into recess or channel 20*b* formed in the underside of arm support 20 and is formed at its top end with curved brake surface 18*b* spaced somewhat below the inner surface 20*c* of arm support 20 at the top of recess 20*b* and which serves as a coacting brake surface. Brake arm 18 is constructed and arranged so that cable 4 which extends from sheave 5a to sheave 5b passes between brake surface 18b of brake arm 18 and coacting brake surface 20c of arm support 20, and so that brake arm 18 is swingable about a pivot pin 18a between an inoperative position out of engagement with cable 4 and an operative (braking) position in engagement with cable 4, as shown in interrupted lines, and in which it clamps the cable against coacting brake surface 20c.

At its lower end, brake arm 18 is pivotally connected to push rod assembly 22 comprising outer bracket 23 connected at one end by pivot 18c to brake arm 18 and threadably connected at its inner end to rod 24, the latter being similarly connected at its inner end to U-shaped inner bracket 25. Rotatably mounted on bracket 25 is roller 26. U-shaped cable retainer 27 is secured to bracket 25 spaced away from roller 26, so that in the assembly cable 4 passes freely between roller 26 and retainer 27 (see FIGS. 4 and 5). Support bracket 28 for slidably holding push rod bracket 25 in position is U-shaped, having spaced flanges 28a,b by which it is secured at opposite sides to sheave bracket 15 and formed with an opening 28c (see FIG. 3) through which push rod bracket 25 is slidably received.

Coil spring 30 secured at one end to bracket 15 and at the other end to brake arm 18 urges the latter arm in a clockwise direction about pivot 18a as viewed in FIG. 3. Stop pin 31 is secured to bracket 15 adjacent the forward edge of brake arm 18.

It will be understood that the described brake device is normally installed on each of the plurality of sheave brackets (typically three) provided on head plate 6, so that a brake device is associated with each of the cables 4 shown in FIG. 2.

In the operation of the described apparatus, when luminaire support 2 is being raised or lowered by operation of winch 10, the tension on cable 4 due to the weight of luminaire support 2 with attached luminaires (not shown) causes push rod assembly 22 to be moved to the foward position against the bias exerted by spring 30, as shown in FIG. 3 by the parts in solid lines. As a result, brake arm 18 is moved counter-clockwise about pivot 18a so that its upper (brake) end 18b is spaced away from cable 4, allowing the latter to freely move through arm support 20 and about sheaves 5a,5b during the raising or lowering procedure.

In the event hoist cable 4 or winch cable 11 breaks within pole 1, cable 4 is no longer in tension and consequently spring 30 pulls brake arm 18 in clockwise direction forcing it into engagement with cable 4 and pushing it toward coacting brake surface 20c of arm support 20. At the same time, the movement of cable 4 toward outer sheave 5b in frictional engagement with brake arm 18 as a result of the cable breakage contributes further to the clockwise movement of brake arm 18 and thus increases the latter's force on the cable for firmly clamping it against coacting brake surface 20c. As a result, further movement of the cable is halted, preventing fall of the luminaire support 2 carried thereby.

Figure 6:
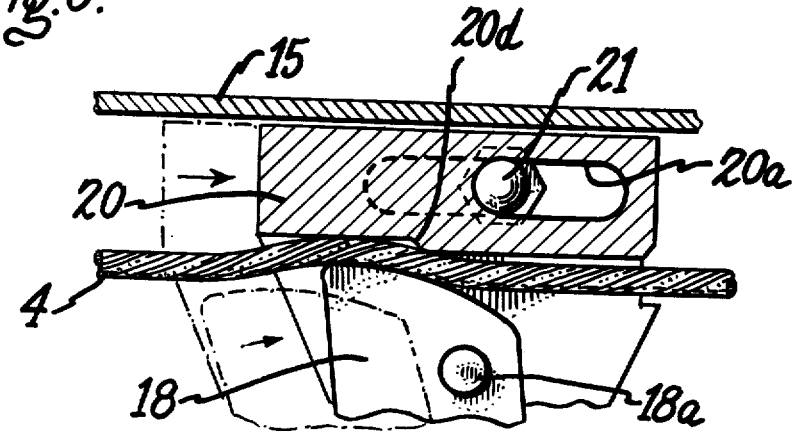
FIG. 6 is a fragmentary detailed view of the brake arm in clamping engagement with the luminaire support cable.

To further enhance this clamping action, coacting brake surface 20c of arm support 20 in accordance with the invention is preferably formed with a step 20d therein, as best seen in FIG. 6, so that as brake arm 18 turns clockwise about pivot 18a as described above, it forces cable 4 against step 20d and thereby increases the braking effect thereon.

In accordance with a further feature of the invention, the slidable mounting of arm support 20 as described provides for shifting of the latter element together with attached brake arm 18 forwardly toward sheave 5b due to movement of cable 4 in that direction in the event of breakage, as previously explained. By such shifting, brake arm 18 comes into contact with stop pin 31 and, as a result, additional clockwise force is applied to brake arm 18 and thereby increasing the braking force on cable 4 even further. As will be understood, the greater the distance between pivot 18a and the point of contact of stop pin 31 on brake arm 18, the greater the torque exerted on the braking end of brake arm 18.

The length of slot 20a in arm support 20 is dimensioned so that arm support 20 can shift forwardly a sufficient distance to bring brake arm 18 into contact with stop pin 31 but not so far as to strike sheave 5b, and so that arm support 20 can shift rearwardly a sufficient distance to allow brake arm 18 to disengage cable 4 but not so far as to strike sheave 5a.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. Hoist apparatus and safety device therefor comprising, in combination, a pole, fixed support means secured at the top of said pole, load support means movable between the top and bottom of said pole, hoist means for raising and lowering said load support means on said pole, cable guide means mounted on said fixed support means, hoist cable means passing around said guide means and connected at one end to said load support means and at the other end to said hoist means, and brake means adjacent to said guide means and in operative engagement with said hoist cable means and responsive to the breakage thereof for automatically clamping and holding said hoist cable means for preventing fall of said load support means.

2. Apparatus as defined in claim 1, said hoist means comprising cable winding means at the bottom of said pole, said hoist cable means extending downwardly on one side of said guide means to said cable winding means and on the other side of said guide means to said load support means and being in tension during raising and lowering of said load support means, said brake means having a brake member movable between an inoperative position out of engagement with said hoist cable means and an operative position in braking engagement with said hoist cable means, and having operating means normally urged by said hoist cable means in a direction for holding said brake member in inoperative position when said hoist cable means is in tension, and yieldable means connected to said brake member for automatically moving the same into operative position upon loss of tension in said hoist cable means due to breakage thereof.

3. Hoist apparatus and safety device therefor comprising, in combination, a pole, fixed support means secured at the top of said pole, load support means movable between the top and bottom of said pole, hoist means for raising and lowering said load support means on said pole, cable guide means mounted on said fixed support means, hoist cable means passing around said guide means and connected at one end to said load support means and at the other end to said hoist means, and brake means adjacent to said guide means and in operative engagement with said hoist cable means and responsive to the breakage thereof for automatically clamping and holding said hoist cable means for preventing fall of said load support means, said hoist means comprising cable winding means at the bottom of said pole, said hoist cable means extending downwardly on one side of said guide means to said cable winding means and on the other side of said guide means to said load support means and being in tension during raising and lowering of said load support means, said brake means having a brake member movable between an inoperative position out of engagement with said hoist cable means and an operative position in braking engagement with said hoist cable means, and having operating means normally urged by said hoist cable means in a direction for holding said brake member in inoperative position when said hoist cable means is in tension, and yieldable means connected to said brake member for automatically moving the same into operative position upon loss of tension in said hoist cable means due to breakage thereof, said brake means comprising a brake support member secured to said fixed support means, said brake member being elongated and having a pivot connection near one end to said brake support member, said elongated brake member being turnable about said pivot connection between said operative and inoperative positions.

4. Apparatus as defined in claim 3, said elongated brake member having a brake surface at said one end, said brake support member having a coacting brake surface adjacent to and spaced from said first-mentioned brake surface, said hoist cable means passing between said spaced brake surfaces.

5. Apparatus as defined in claim 4, said brake support member being slidable along the path of said hoist cable means, and stop means on said fixed support means adjacent said elongated brake member between said pivot connection and the opposite end of said brake member.

6. Apparatus as defined in claim 5, said guide means comprising a pair of spaced inner and outer rotatable members, said brake support member and attached elongated brake member being arranged between said spaced rotatable members, said operating means comprising an elongated assembly pivotally connected at one end to said opposite end of said elongated brake member and in operative engagement at its other end with said hoist cable means extending downwardly from the inner side of said inner rotatable member.

7. Apparatus as defined in claim 6, said elongated assembly being connected to said elongated brake member for normally urging said elongated brake member in a first direction to said inoperative position thereof in response to said hoist cable means in tension, said yieldable means comprising a spring having one end connected to said fixed support means and an opposite end connected to said elongated brake member for turning said elongated brake member in the opposite direction to said operative position thereof upon loss of tension in said hoist cable means.

8. Apparatus as defined in claim 4, said coacting brake surface having a stepped portion for receiving said hoist cable means when clamped by said elongated brake member.

9. Apparatus as defined in claim 6, said pole being hollow, said hoist cable means extending within said hollow pole, and winch means within said pole at the bottom thereof for winding and unwinding said hoist cable means.

10. Apparatus as defined in claim 1, said load support means comprising an annular member surrounding said pole for carrying a plurality of luminaires.

* * * * *